United States Patent [19]

Roberts

[11] 3,945,645

[45] Mar. 23, 1976

[54] TANGENTIAL SPHERES GEOMETRIC PUZZLE

[76] Inventor: Patrick A. Roberts, 4208 Jefferson St., Hyattsville, Md. 20781

[22] Filed: Sept. 23, 1974

[21] Appl. No.: 508,635

[52] U.S. Cl. ..... 273/157 R
[51] Int. Cl.[2] ..... A63F 9/12
[58] Field of Search..... 273/157 R, 146; 35/18 A, 35/34, 72

[56] References Cited

UNITED STATES PATENTS

| | | | |
|---|---|---|---|
| 1,709,660 | 4/1929 | De Bracht | 273/157 R |
| 2,942356 | 6/1960 | Weintraub | 35/18 A |
| 3,091,870 | 6/1963 | Sangster | 35/18 A X |
| 3,837,652 | 9/1974 | Kuwagaki et al. | 273/157 R |

FOREIGN PATENTS OR APPLICATIONS

| | | | |
|---|---|---|---|
| 52,215 | 9/1936 | Denmark | 273/157 R |

OTHER PUBLICATIONS

Martin Gardner's New Mathematical Diversions from Scientific American, publ. by Simon & Schuster, New York, 1966, pp. 82–90.

*Primary Examiner*—Anton O. Oechsle
*Attorney, Agent, or Firm*—Low & Matthews

[57] ABSTRACT

A tangential spheres geometric puzzle uniquely formed from nine assembly pieces, of which eight pieces are based upon a triangular sphere array and a ninth piece based upon spheres disposed in a square array, providing a challenging educational and manipulative game. The pieces are assemblable into a tetrahedral pyramid.

8 Claims, 20 Drawing Figures

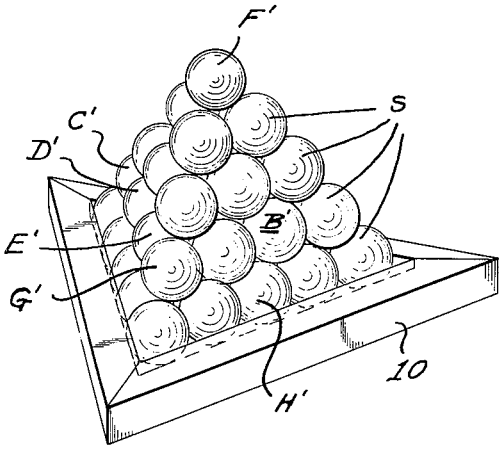
Fig. 1
Fig. 2
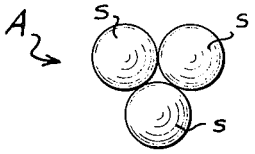
Fig. 3
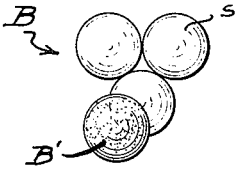
Fig. 4
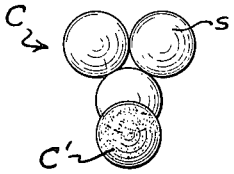
Fig. 2a
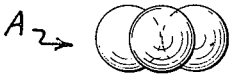
Fig. 3a
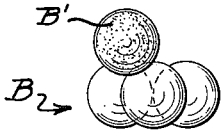
Fig. 4a
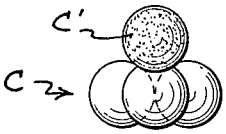
Fig. 5
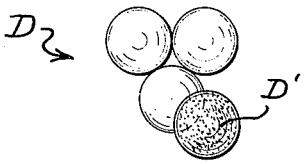
Fig. 6
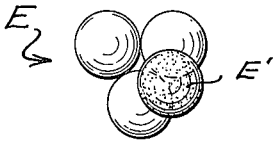
Fig. 7
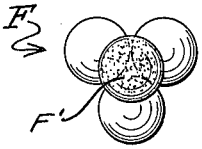
Fig. 5a
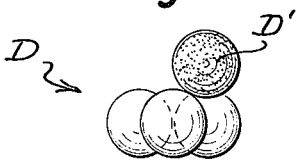
Fig. 6a
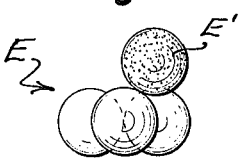
Fig. 7a
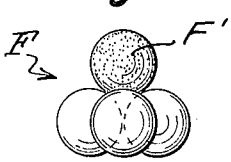

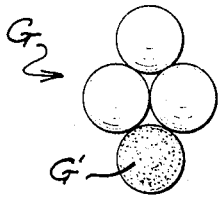
Fig. 8
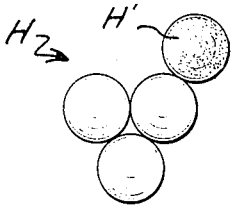
Fig. 9
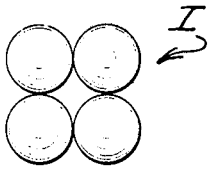
Fig. 10
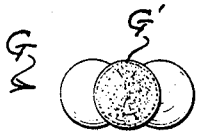
Fig. 8a
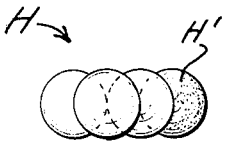
Fig. 9a
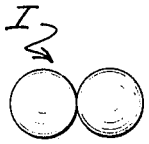
Fig. 10a
Fig. 11
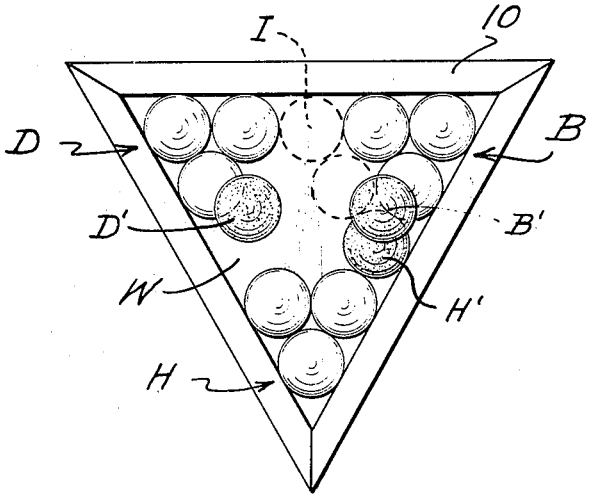

TANGENTIAL SPHERES GEOMETRIC PUZZLE

BACKGROUND OF THE INVENTION

A number of puzzles have been developed over the years involving the stacked and nested arrangement of diverse geometric configurations. These puzzles have many beneficial uses, including the stimulus of mental challenge, topographic and orientation determinations, and manual dexterity and manipulative skills.

One such puzzle of the foregoing general type and bearing at least some relationship to the subject invention are the so-called Soma blocks wherein smaller cubic members are interconnected in diverse arrays and may be arranged to form a large cube, for example.

BRIEF SUMMARY OF THE INVENTION

The present invention provides a challenging puzzle which in the specific form disclosed utilizes a total of 35 spheres which have been grouped into only nine assembly pieces which together define an attractive pyramidal or tetrahedron-like shape received within a supporting or bounding frame.

The nine component pieces are unique in that eight of the same comprise diverse arrangements of four spheres tangentially attached in predetermined arrays, and a ninth assembly piece of only three spheres.

There is likewise the further feature that of nine assembly pieces, eight are based upon and devolve from a triangular planar array of spheres while the ninth piece locates the spheres in square array.

Consequently, while there are not an undue multiplicity of pieces to weary or tax the player, nonetheless, their relative multi-sphere similarity and their geometric aesthetic beauty provide a considerable yet enjoyable challange in assembling the puzzle.

BRIEF DESCRIPTION OF THE DRAWINGS

FIG. 1 is a perspective view of the assembled puzzle in its retainer frame;

FIGS. 2 through 10, inclusive, are plan views of each of the different nine assembly pieces of the puzzle;

FIGS. 2*a* through 10*a*, inclusive, are front elevations of the respective pieces seen in FIGS. 2 through 10, inclusive; and, FIG. 11 is a view of the puzzle partially assembled with three pieces in place in accordance with one known plan of assembly.

DETAILED DESCRIPTION OF THE INVENTION

As best seen in the perspective view of FIG. 1, the puzzle when assembled comprises an attractive pyramidal array of substantially identical spheres S within a suitable bounding or retaining triangular frame 10.

The spheres S may of course be of any desired size. As such, the same may be on the order of small pellets or ball bearings for a game or puzzle readily carried upon the person, or might comprise individual ball-like elements of some substantial diameter such as the size of tennis balls or oranges for easier manipulation by younger persons or those with handicapped vision, for example. A convenient size for the game for average use might be with spheres on the order of conventional marble size, with the spheres ¾ to 1 inch in diameter.

Widely available choices reside with respect to materials of which the spheres are formed, the only requisite being that the same be formed from materials which are sufficiently firm or rigid to resist ready deformation or collapse and that the several spheres forming each individual assembly piece A through I, inclusive, be capable of ready permanent interconnection at tangential points to form the several pieces so that they may be manipulated, stacked, and occasionally inadvertently tumbled without separation or rupture.

In one actual embodiment, the game pieces were formed from substantially transparent spheres of acrylic plastic which were affixedly adhered to each other by a suitable plastic cement to form the several pieces.

It will be readily seen that with a suitable choice of color of the spheres, their sizes, etc., the puzzle can adapt itself to diverse age groups or mental levels, as well as serve various health-related purposes of mental and physical therapy, or development of dexterity and manipulative skills generally.

Returning now to the several game pieces identified in FIGS. 2–10 as game pieces A–I, inclusive, it will readily be seen that the basic array of spheres S for the eight pieces A–H is a three-sphere planar array. With respect to assembly piece A in FIG. 2, exactly three spheres S lying in a common plane are affixed with each sphere tangentially contacting two other spheres.

In FIG. 3 it will be seen that game piece B employs the basic arrangement of piece A with the further addition of a fourth sphere B′ tangentially affixed to and extending upward from a single one of the spheres S and slightly forward thereof. As seen in FIG. 3A the shaded fourth sphere B′ is inclined to the vertical approximately 30 degrees.

In piece C of FIG. 4, the arrangement is similar to piece B, wherein the fourth ball C′ is not tilted laterally but rather shares the same vertical plane with the subjacent sphere to which it is attached as is clearly evident from FIG. 4*a*.

The fourth piece D, as seen in FIG. 5, continues with the same basic three-sphere arrangement of FIG. 2 but wherein the fourth ball D′ is inclined to the right as contrasted with FIG. 3 wherein the comparable ball B′ is inclined to the left with respect to the subjacent triangle.

In FIG. 6, piece E disposes its fourth sphere E′ in tangential contact with two of the three base spheres and is canted outwardly about 30° from a vertical plane through the subjacent spheres. The sixth piece F, FIG. 7, constitutes a four sphere pyramid wherein the fourth sphere F′ is disposed centrally of and in mutual tangential contact with the spheres of the base triangle.

Assembly piece G in FIG. 8 is characterized by the fact that the fourth sphere G of the array lines in a common plane with the basic triangle and is tangentially affixed to two spheres thereof, forming a diamond-shaped or rhombus-like figure.

In FIG. 9, the eighth and final piece H of the several pieces based upon the particular common triangular member, is similar to FIG. 8 in that the fourth sphere H′ lies in a common plane with the triangular array, but wherein the same is tangent to only one ball and forming an extension of any one side of the triangle into a three-sphere straight line.

The final piece I of the nine piece set as noted departs from the particular arrangement characteristic of all other pieces, wherein the four-sphere array is square in planar layout as is clearly evident.

Thus it will be seen that the nine assembly pieces of the subject puzzle as described herein are each of themselves possessive of considerable similarity of appearance and common features enhancing both the aesthetic and novel features thereof in arranging the same to form the completed puzzle of FIG. 1.

Further, in the total 35 sphere puzzle of the disclosed and preferred embodiment, each piece contains four spheres with the exception of but one piece, which piece A, FIG. 2, contains only three spheres, to total only 35 in all.

For convenience in assembling the puzzle, there is preferably provided a peripheral retainer 10 much on the order of a rack for billiard balls which facilitates positioning the pieces and preventing the same from sliding laterally as they are vertically stacked. While the complete array is inherently stable, inasmuch as no pieces are capable of rolling movement, improper positioning of one or more pieces tends to cause lower pieces to separate or slide relative to one another, thereby handicapping their ready return to a preexisting arrangement without the use of a device such as a retainer frame 10. To facilitate transfer or display of the completed puzzle, the retainer frame 10 may include a bottom wall W as seen in FIG. 11.

In one mode of assembling the pieces to form the completed puzzle and to illustrate the manner in which the retainer 10 facilitates positioning thereof, the partially assembled puzzle is seen in FIG. 11 with three pieces in position, namely, piece D in the upper left-hand corner, piece B in the upper right-hand corner and piece H in the lower central position within the frame.

In this particular assembly mode for the puzzle, the final piece to be positioned will be piece F of FIG. 7 as a cap piece with the parts arranged as shown.

To complete the puzzle from the FIG. 11 position to the FIG. 1 position, piece I would be positioned with one sphere thereof between parts B and D and an adjacent sphere thereof also adjacent piece B and thus slightly beneath element B′ thereof, as indicated in dashed lines. With sphere B′ in the position shown, the entire piece I would thus lean or cant slightly bodily toward piece D, to dispose the upper spheres thereof tangent to sphere D′.

Positioning of piece I would thus leave a total of three spaces available on the floor W in a generally triangular array between pieces B and H which would be filled by piece E with the element E′ extending up into the second level adjacent upstanding element D′ of piece D.

Thereafter, in the second layer, piece G would be positioned with two spheres resting upon pockets in the subjacent layer with one of the spheres abutting piece B′ and forming a continuation of that side of the triangle, the remaining two spheres of piece G extending upwardly into the third layer of the pyramid. Thence element C would be positioned with the element C′ thereof depending into the pocket formed by the three base spheres of piece D. Thereby all that need be done is for basic triangular piece A to be positioned upon piece B with two spheres thereof in the pockets formed between the spheres of piece B, and the third sphere of piece A lying adjacent piece B′, after which the cap piece F is placed thereon to complete the fourth and fifth (one sphere) layers of the pyramid.

Other modes of assembly are, of course, possible including rotations and reflections of that described, but that described and illustrated being one form thereof to complete the description of the invention.

While I have shown and described a preferred embodiment of my invention, it is to be understood that modifications and alterations thereof might be effected within the spirit and scope of the invention and the appended claims. Thus, while still incorporating the disclosed features, the puzzle may incorporate a fewer or greater number of spheres, or the spheres may be detachable one from the other for rearrangement, for example. Further, other solutions in addition to that described may be determinable upon suitable manipulation.

I claim:

1. A geometric puzzle of tangential spheres for array in a tetrahedral pyramid comprising a plurality of discrete and geometrically different assembly pieces for assembling said puzzle, each said piece including at least three tangentially affixed spheres in non-linear array, wherein further all said pieces but one of said pieces include identical triangular arrays of three spheres, and wherein selected ones of said triangular array pieces include a further sphere tangentially affixed to one of said triangular spheres in respectively different positions out of the plane of said triangular array, said plurality of pieces when arranged in a predetermined order defining said tetrahedral pyramid with all face portions and internal areas thereof of the size of said spheres occupied thereby.

2. The puzzle of claim 1 including a retainer frame bounding the pyramid array of spheres about its base and within which said pieces are placed to assemble the puzzle.

3. The puzzle of claim 1 wherein each assembly piece includes at least four spheres excepting one piece having only three spheres, thereby comprising nine assembly pieces for said puzzle.

4. The puzzle of claim 1 wherein said one piece comprises a planar square array of four spheres.

5. The puzzle of claim 1 wherein said spheres are of substantial size on the order of several inches in diameter, thereby to facilitate manipulation by the visually handicapped.

6. The puzzle of claim 1 wherein said spheres are of small size on the order of small pellets or ball bearings, thereby to enhance ready pocket portability.

7. The puzzle of claim 1 wherein a line between the center of each said further sphere and said one triangular array sphere is disposed at an angle to a line extending through the center of said adjacent triangular array sphere to which it is affixed with said latter line perpendicular to the plane of said triangular array.

8. The puzzle of claim 7 wherein said angle is on the order of 30°.

* * * * *